United States Patent [19]

Güntert et al.

[11] Patent Number: 4,630,586

[45] Date of Patent: Dec. 23, 1986

[54] FUEL INJECTION PUMP FOR INTERNAL COMBUSTION ENGINES

[75] Inventors: Josef Güntert, Gerlingen; Walter Häfele, Fellbach, both of Fed. Rep. of Germany

[73] Assignee: Robert Bosch GmbH, Stuttgart, Fed. Rep. of Germany

[21] Appl. No.: 730,539

[22] Filed: May 6, 1985

[30] Foreign Application Priority Data

Jul. 31, 1984 [DE] Fed. Rep. of Germany ..... 3428174

[51] Int. Cl.[4] ..... F02M 37/04

[52] U.S. Cl. ..... 123/500; 123/503; 417/289

[58] Field of Search ..... 123/503, 501, 500, 504; 417/289

[56] References Cited

U.S. PATENT DOCUMENTS

| | | | |
|---|---|---|---|
| 2,810,375 | 10/1957 | Froehlich et al. | 123/500 |
| 2,980,092 | 4/1961 | Dreisin et al. | 123/449 |
| 4,211,520 | 7/1980 | Kranc | 123/500 |
| 4,327,694 | 5/1982 | Henson et al. | 123/503 |
| 4,367,714 | 1/1983 | Di Domenico et al. | 123/500 |
| 4,448,167 | 5/1984 | Schmid et al. | 123/503 |

FOREIGN PATENT DOCUMENTS

| | | | |
|---|---|---|---|
| 2058947 | 4/1981 | United Kingdom | 123/503 |

*Primary Examiner*—Magdalen Y. C. Greenlief
*Attorney, Agent, or Firm*—Edwin E. Greigg

[57] ABSTRACT

A fuel injection pump is proposed for internal combustion engines having a control slide displaceable on the pump piston. The control slide cooperates with an oblique groove on a pump piston. The oblique groove is arranged to communicate via a conduit with a pump work chamber. The pump piston is rotatable and has a longitudinal groove of predetermined length on its jacket surface, which groove is adapted to communicate with the oblique groove and with its end remote from the pump work chamber determines the supply onset of the pump by plunging into the control slide.

9 Claims, 4 Drawing Figures

FUEL INJECTION PUMP FOR INTERNAL COMBUSTION ENGINES

BACKGROUND OF THE INVENTION

The invention is based on a fuel injection pump as generally defined hereinafter. In a known fuel injection pump of this type (German Offenlegungsschrift 24 46 903), the supply onset of the injection pump is determined by the plunging of the oblique groove into the control slide, after which the conduit leading to the pump work chamber is blocked, so that the injection pressure can build up therein. The end of supply and thus the injection quantity is determined by the rotational position of the control slide, according to which the required stroke of the pump piston between the supply onset and the opening of the discharge bore is variable by the oblique groove. Viewed in terms of the drive shaft (camshaft), the supply onset (injection onset) is varied by the axial displacement of the control slide, and the injection quantity itself is determined by the rotation of the control slide.

Because of the obliquity of the oblique groove, its blockage to effect the supply onset is not effected with an abrupt closure, as desired; instead, there is a gentler transition, on the order of a pre-stroke control. In cooperation with the control of the end of supply, this makes exact metering difficult, because the throttle effect resulting in this type of control is variable in accordance with rpm. While a relatively large amount of fuel can still flow out at low rpm, less fuel is diverted at high rpm, because of the increased throttling effect that results. Since this effect seldom corresponds to the desired course of the fuel quantity, it must be corrected once again by a regulating apparatus. Because the filling of the pump work chamber also takes place via the oblique groove in the vicinity of bottom dead center of the pump piston, the conduit extending in the pump piston must be extended far downward, in order to attain sufficient filling, but this means that there is a relatively large idle volume. With this type of fuel quantity control problems arise when the engine is shut off, that is, not the least of which is a zero supply quantity. To this end, the control slide is rotated such that the diversion bore opens the oblique groove before the lower end of this groove plunges into the control slide. At higher rpm, the resultant throttling effect produces a residual injection quantity, instead of the immediate interruption of injection that is desired. Pumps of this kind, controlled by a control slide, are primarily used for very large engines, in which this undesirable injection is particularly disadvantageous, sometimes even dangerous, because these motors, after the fuel is shut off, are substantially stopped by means of their inherent compression.

OBJECT AND SUMMARY OF THE INVENTION

The fuel injection pump according to the invention has the advantage over the prior art that at relatively little expense, in particular in manufacturing such pumps, a complete interruption of injection supply, and hence reliable shutoff of the engine, is attainable by rotating the pump piston with the diversion bore and the longitudinal groove coinciding; furthermore, because of the horizontal control edge, the supply onset is substantially constant over the rpm, because a pre-supply of fuel virtually no longer occurs.

According to an advantageous embodiment of the invention, the end of the longitudinal groove facing the pump work chamber determines the end of supply in the upper load range by means of its emergence from the control slide.

According to a further feature of the invention, a longitudinal blind bore extending centrally in the pump piston and a radial bore which discharges into the end of the longitudinal groove facing the pump work chamber serve as the conduit. This shortens the blind bore considerably, which reduces the idle volume. The reduction of the idle volume is of particular significance in these large pumps, because they operate with high pressures, which result in a correspondingly great compression and thus a correspondingly great variation in the fuel volume. If dynamic effects such as throttling are taken into consideration as well, changes in volume can have a considerable influence on the control of the fuel quantity.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
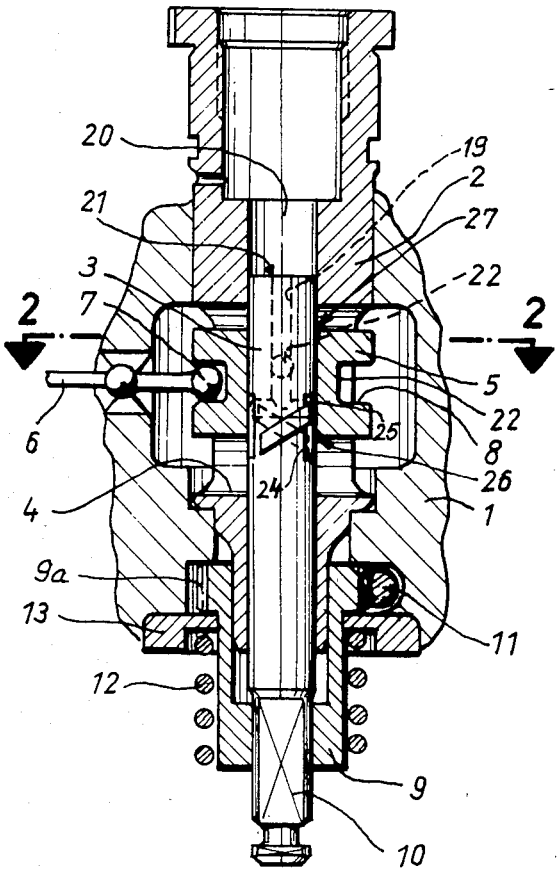
FIG. 1 is a fragmentary cross-section through a fuel injection pump according to the invention.
Figure 2:
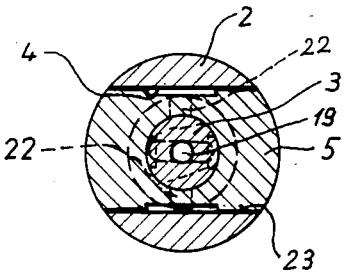
FIG. 2 is a cross section taken along the line II—II of FIG. 1.
Figure 3:
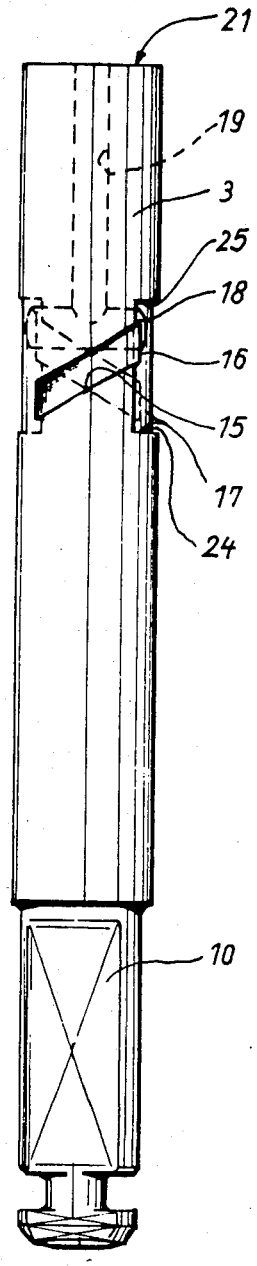
FIG. 3 shows the pump piston of FIG. 1 in elevation on an enlarged scale.
Figure 4:
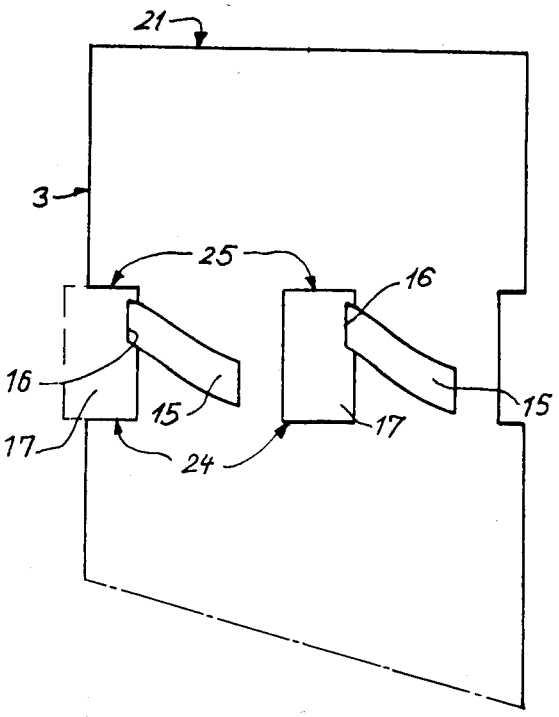
FIG. 4 is a development of the jacket face of the pump piston in the control area.

Cylinder bushings 2, typically a plurality thereof, are inserted in a row in a housing 1 of a fuel injection pump. Pump pistons 3 are driven axially within these bushings 2 by a camshaft, not shown. A recess 4 is provided in the cylinder bushing 2 which receives a control slide 5 that is axially displaceable on the pump piston 3.

The control slide 5 can be axially displaced by means of a lever 6 supported by the housing, to which end this lever, with a head 7, engages a groove 8 of the control slide 8.

The pump piston 3 can be rotated by a bushing 9 about a predetermined angular extent. The bushing 9 engages a flattened area 10 of the pump piston 3, as a result of which the stroke movement of the pump piston is unhindered. The bushing 9 has a toothed ring **9*a* in its upper portion, which is engaged by a rack 11 serving as a regulating rod. Naturally any other desired device may be used as a means of imparting rotation. Via a spring 12, which is supported on a spring plate 13, the pump piston 3** is pressed against the cams with a roller tappet, not shown.

Oblique grooves 15 are axially symmetrically disposed on the jacket face of the pump piston, discharging at their upper end 16 into longitudinal grooves 17. The upper ends of the longitudinal grooves 17 communicate with one another through a radially extending transverse bore 18, into which a blind bore 19 extending centrally in the pump piston 3 discharges. The blind bore 19 terminates on the end 21 of the pump piston 3 that defines the pump work chamber 20. The transverse bore 18 and the blind bore 19 form a conduit between the oblique bore 15 and the pump work chamber 20. Two radial diversion bores 22 are provided in the control slide 5, cooperating with the oblique grooves 15 and the longitudinal grooves 17 to determine the injection quantity. The wall faces 23 of the recess 4 are located opposite the mouths of these diversion bores 22, and so these wall faces 23 accordingly serve as impact protection for the diverted fuel. The longitudinal grooves 17 have sharp control edges 24 and 25 at the bottom and top, which cooperate with the lower and upper end face 26 and 27 of the control slide 5, which likewise have sharp control edges.

The fuel injection pump according to the invention functions as follows:

Whenever the pump piston 3 assumes the bottom dead center position shown in the FIG. 1, the longitudinal grooves 17 are uncovered by the control slide 5, so fuel can flow virtually unthrottled into the pump work chamber 20 via the conduit formed by the transverse bore 18 and the blind bore 19. Now as soon as the supply stroke of the pump piston 3 begins, the longitudinal groove 17 plunges into the control slide 5 sooner or later, depending on the axial position of the control slide 5. As soon as the lower control edge 24 of the longitudinal groove 17 travels past the lower control edge 26 of the control slide 5, then the pressure required for injection can build up in the pump work chamber 20, and the injection supply can begin. This supply takes place until such time as the diversion bore 22 of the control slide 5 is opened by the oblique groove 15 and the injection is interrupted. As the pump piston 3 continues its stroke the fuel flows out of the pump work chamber 20 back to the intake side of the pump. Beyond a predetermined axial length of the control slide 5 the longitudinal groove 17 then emerges at the top from the control slide 5, and the upper end edge 27 partially uncovers the longitudinal groove 17.

In a predetermined rotational position of the pump piston 3, the diversion bore 22 is in axial alignment with the longitudinal bore 17, so that the diversion bore 22 is opened by the longitudinal groove 17 before the longitudinal groove 17 plunges into the control slide 5. As a result, a constant communication between the pump work chamber 20 and the intake side of the pump is assured, and no fuel supply takes place in this shutoff position.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patents of the United States is:

1. A fuel injection pump for internal combustion engines comprising at least one rotatable pump piston having a jacket face provided with a longitudinal groove and defining a pump work chamber, a control slide on said piston, a radial diversion bore arranged to control an oblique groove on said pump piston jacket face, said control slide axially displaceable on said pump piston, said oblique groove further arranged to communicate with said pump work chamber via a conduit in said pump piston, the aforesaid longitudinal groove has an end arranged to communicate with an end of said oblique groove in proximity to said pump work chamber, and said longitudinal groove further including an end zone remote from said pump work chamber arranged to be uncovered by said control slide, at least at bottom dead center of said pump piston, whereby plunging of said pump piston into said control slide predetermines the supply onset of said injection pump.

2. A fuel injection pump as defined by claim 1, further wherein end of fuel supply is determinable at the latest by means of the emergence of said end zone of said longitudinal groove oriented toward the pump work chamber from said control slide.

3. A fuel injection pump as defined by claim 1, further wherein said pump piston further includes a longitudinal blind bore and a radial bore, and said radial bore discharges into said end of said longitudinal bore which is oriented toward said pump work chamber.

4. A fuel injection pump as defined by claim 2, further wherein said pump piston further includes a longitudinal blind bore and a radial bore, and said radial bore discharges into said end of said longitudinal bore which is oriented toward said pump work chamber.

5. A fuel injection pump as defined by claim 1, further wherein for pressure equalization of said pump piston, two each axially symmetrical radial bores, oblique bores, longitudinal bores and radial diversion bores are present.

6. A fuel injection pump as defined by claim 1, further wherein said pump includes an assembly comprising a plurality of pump pistons and cooperative control slides which are present in the form of pumping elements arranged in a row, and that at least a portion of the pump pistons and control slides are displaceable by means of a common adjusting member.

7. A fuel injection pump as defined by claim 6, further wherein said assembly includes at least one housing means.

8. A fuel injection pump as defined by claim 1, further wherein said pump includes an assembly comprising a plurality of pump pistons and cooperative control slides which are present in the form of pumping elements arranged in a row, and that at least a portion of the control slides are displaceable by means of a common adjusting member.

9. A fuel injection pump as defined by claim 1, further wherein said pump includes an assembly comprising a plurality of pump pistons and cooperative control slides which are present in the form of pumping elements arranged in a row, and that at least a portion of the pump pistons are displaceable by means of a common adjusting member.

* * * * *